United States Patent [19]

MacDonald et al.

[11] 4,432,463

[45] Feb. 21, 1984

[54] WINE STORAGE CONTAINER

[76] Inventors: Leslie R. MacDonald, 15 Balfour Rd., Springfield, South Australia; Wouter Verschoor, 5 Enford St., Elizabeth, South Australia, both of Australia

[21] Appl. No.: 245,084

[22] Filed: Mar. 18, 1981

[30] Foreign Application Priority Data

Mar. 25, 1980 [AU] Australia ..... PE2910

[51] Int. Cl.[3] ..... B65D 6/24

[52] U.S. Cl. ..... 217/12 R; 217/65; 220/4 F; 220/81 R; 220/84

[58] Field of Search ..... 217/4, 12 R, 65, 69; 52/426, 562; 249/36, 38, 40, 43, 47, 190, 192; 220/4 F, 81 R, 84; 426/422, 15

[56] References Cited

U.S. PATENT DOCUMENTS

| | | | |
|---|---|---|---|
| 926,230 | 6/1909 | Auery | 217/12 R |
| 997,755 | 7/1911 | Coshe | 217/12 R |
| 1,475,573 | 11/1923 | George | 217/12 R |
| 1,534,643 | 4/1925 | Hopkins | 217/4 |
| 1,604,855 | 10/1926 | Skitt | 220/81 R X |
| 1,916,958 | 4/1933 | Brooks | 217/4 |
| 1,920,837 | 8/1933 | Birdsey | 220/4 F |
| 2,385,954 | 10/1945 | Tarnopol | 217/4 |
| 2,506,728 | 5/1950 | McGrath | 220/81 R X |
| 2,534,188 | 12/1950 | Weber, Jr. | 217/4 |
| 2,961,113 | 11/1960 | Kienlen | 217/65 X |
| 3,334,175 | 8/1967 | Vincent | 220/81 R X |
| 4,093,099 | 6/1978 | Spooner | 217/69 X |

FOREIGN PATENT DOCUMENTS

| | | | |
|---|---|---|---|
| 830763 | 1/1952 | Fed. Rep. of Germany | 217/12 R |

*Primary Examiner*—Allan N. Shoap
*Attorney, Agent, or Firm*—Charles A. Blank

[57] ABSTRACT

A wine container has a peripheral metal frame which defines the upper, lower and end walls, the side walls being timber panel assemblies which are sealably clamped to the peripheral metal frame by respective clamping frames.

5 Claims, 5 Drawing Figures

WINE STORAGE CONTAINER

This invention relates to a container which is useful for the storage of wine.

BACKGROUND OF THE INVENTION

For certain types of wine, it is desirable that the wine should be stored in containers in contact with one side of each of a plurality of staves of French or American oak, the oak staves being in contact with the air on their other sides. The oak imparts certain flavour characteristics which are deemed to be most desirable.

Heretofore use has been made of oak casks made by traditional methods, being formed to a bulbous shape in the centre from a plurality of staves each of which has been individually shaped. After the casks have been used for some time their effectiveness in imparting flavour is substantially reduced, and frequently the timber is shaved on the inside of the casks to rejuvenate it.

This common practice is extremely wasteful of materials. Much scarce and expensive special oak is lost in being shaved. The shaving is a difficult and slow operation. Furthermore, sometimes casks are made with oak staves which have to be discarded because they are porous.

These difficulties have been recognised, and attempts have been made to reduce the cost by utilising stainless steel vats for containing the wine, in which are immersed oak chips. However, this is only partially successful, as apparently the oak requires to "breathe" when the wine is in contact with it, in order to successfuly transfer the flavour components to the wine.

The main object of this invention is to provide improvements whereby maximum usage will be made of available timber, whereby a wine container can be readily handled by mechanical handling means, and whereby the timber can freely breathe on the outer surface while it contains the wine on the inner surface.

The relationship of volume/area of timber in a cask is fixed, and the larger the volume of a cask, the less the ratio of surface area to volume becomes. It is another object of this invention to provide means whereby the dimensions may be altered to achieve any one of a range of volume/area ratios.

BRIEF SUMMARY OF THE INVENTION

A wine container has a peripheral metal frame which defines the upper, lower and end walls, the side walls being timber panel assemblies which are sealably clamped to the peripheral metal frame by respective clamping frames.

More specifically, in this invention a wine container comprises a peripheral frame of metal defining upper, lower and end walls of the container, a pair of clamping frames, one on each side of the peripheral frame, a pair of timber panel assemblies, one on each side of the peripheral frame, respective resilient jointing means between the peripheral frame and the timber panel assemblies, and means between said clamping frames clamping the timber panel assemblies into sealable engagement with the peripheral frame so that the timber panel assemblies define the side walls of the container.

With this invention, it will be seen that since the container is substantially rectangular in shape, it can be very effectively used with respect to available space in a winery, and can be easily handled by mechanical means. In some embodients of the invention the peripheral frame has secured thereto a pair of fork lift bases, and in other embodiments of the invention there is alternatively or additionally provided a plurality of lifting loops secured to the peripheral frame near its upper edges.

BRIEF DESCRIPTION OF THE DRAWINGS

An embodiment of the invention is described hereunder in some detail with reference to, and is illustrated in, the accompanying drawings, in which.

In this embodiment a wine container 10 is generally rectangular in plan and in each of its elevations.

A peripheral frame 11 is formed from a grade of stainless steel suitable for the wine industry folded at the time of manufacture to a channel shape to have the web 12 defining the inner walls of the container 10 and the flanges 13 directed outwardly therefrom.

Figure 1:
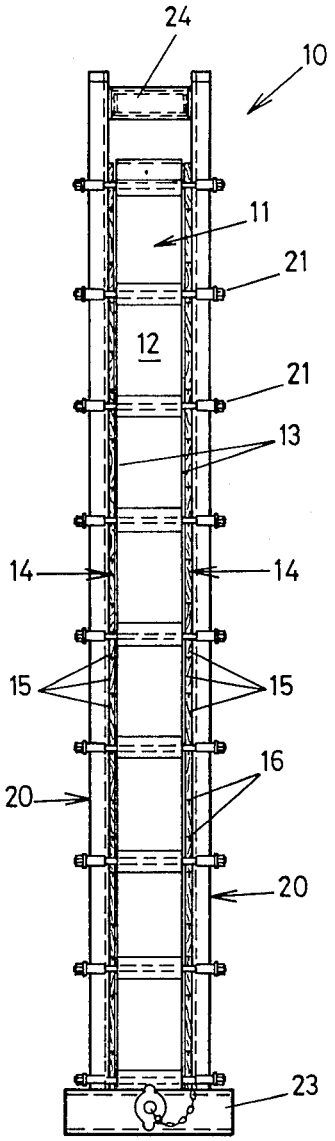
FIG. 1 is an end elevation of a wine storage container.
Figure 2:
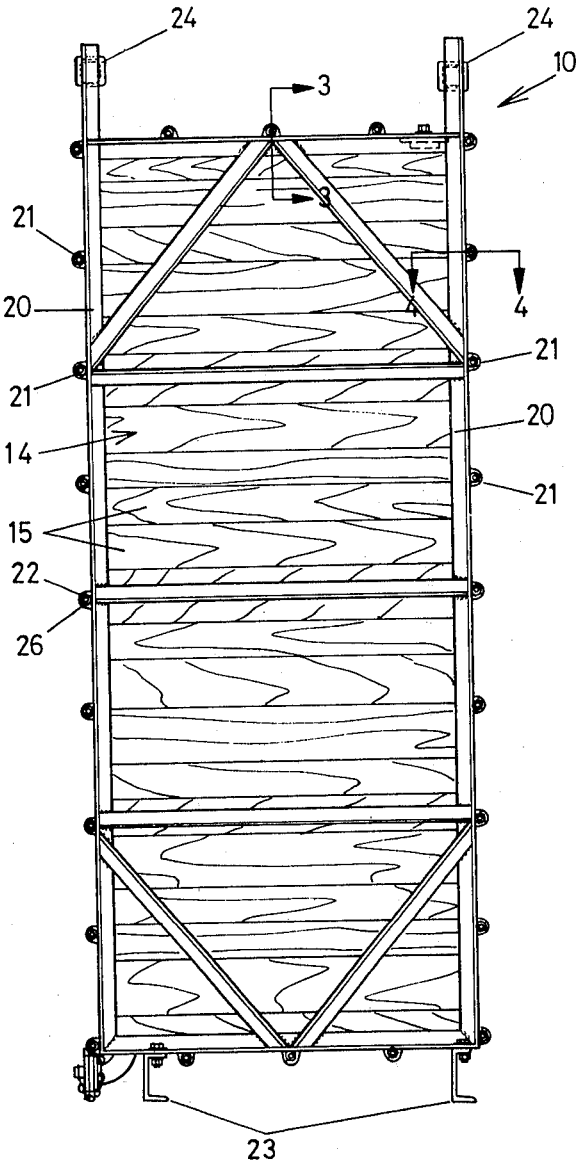
FIG. 2 is a side elevation of same.
Figure 3:
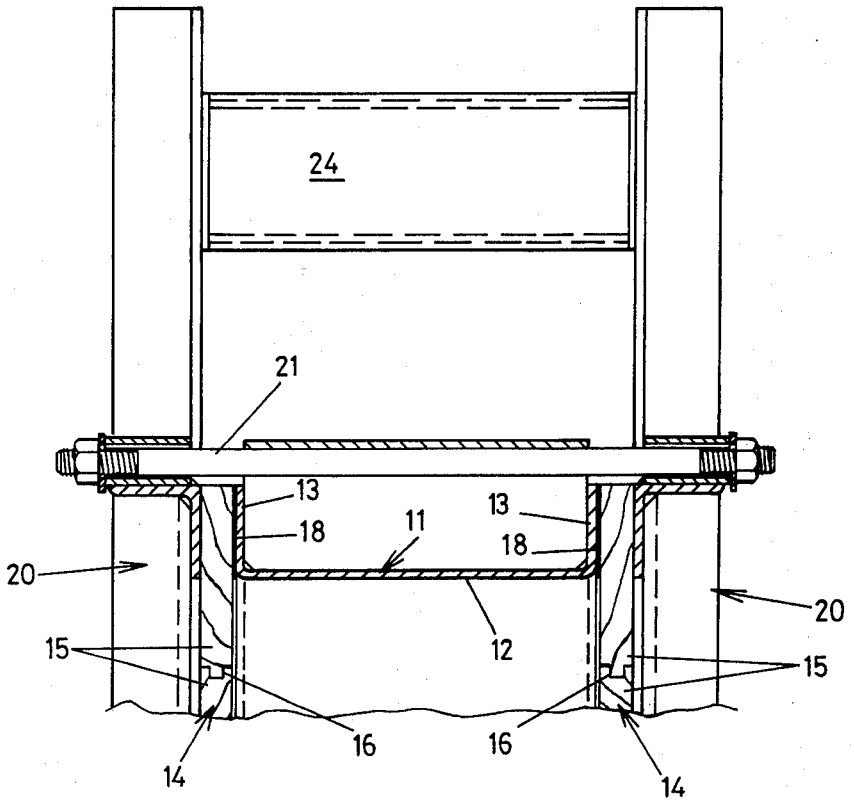
FIG. 3 is an enlarged fragmentary section taken on line 3—3 of FIG. 2.
Figure 4:
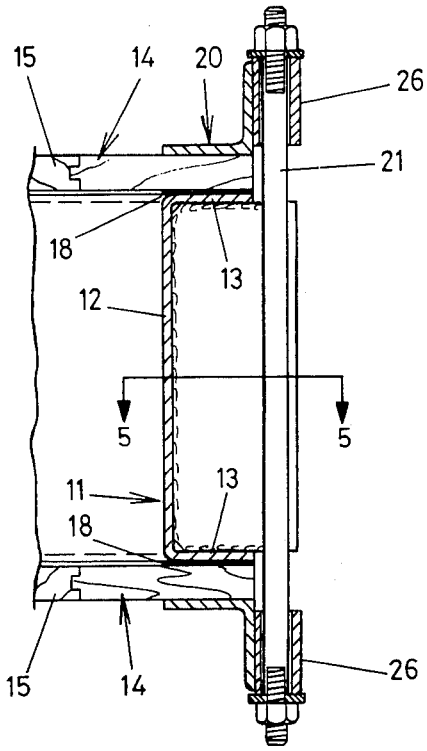
FIG. 4 is an enlarged fragmentary section taken on line 4—4 of FIG. 2.
Figure 5:
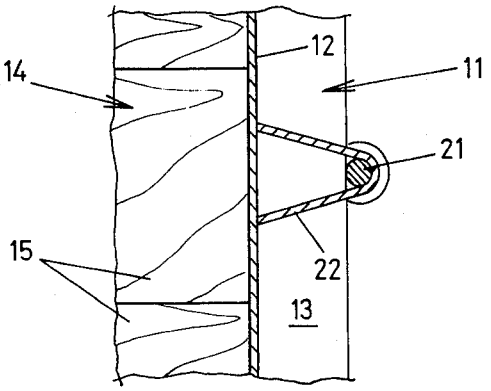
FIG. 5 is an enlarged fragmentary section taken on line 5—5 of FIG. 4.

As shown in FIGS. 1, 2 and 3, a pair of timber panel assemblies 14 are located with one assembly 14 on each open vertical side framed by the peripheral frame 11, each timber panel assembly 14 comprising a plurality of oak timbers or staves 15 lying in edge to edge relationship with adjacent staves 15, and the interfaces between the staves are interlocked with tongue and groove joints 16. A resilient gasket 18 is located against the inner face of, and near the periphery of, each of the timber panel assemblies 14, and reduces likelihood of leakage at the periphery. Each timber panel assembly 14 is clamped into sealable engagement against flanges 13 by means of a respective clamping frame 20, each clamping frame 20 being formed from angle section steel (which can for example be mild steel) and clamped to the other clamping frame with tension bolts 21. 'U'-shaped brackets 22 locate the bolts 21 on the peripheral frame 11, and sleeves 26 on the angle section members of the clamping frame 20 guide the bolts 21, and inhibit tipping of angles.

The timer staves 15 which are used in the wine making industry are likely to be of varying width, but with this invention it is merely necessary that each timber panel assembly overall dimension should correspond to the space within the resilient gasket, so that the timber panel assemblies are firmly clamped with relation to one another edge to edge. The resilience of the gasket 18 enables some expansion to take place across grain without necessarily buckling the timber panel assembly. In the event that different width staves are used, the panel assemblies can be completed as far as possible and a filler piece used for the last timber stave, the filler piece being the only timber member which needs to be separately sized. In the event that one of the staves is found to leak, this is simply and easily replaced with another stave of approximately the same dimension, and if necessary the filler panel width is adjusted.

The base of the peripheral frame 11 has welded to it a pair of bases 23 of channel section, the lengths of which slightly exceed the overall width of the container, and which lift the lower wall of the frame from the floor, and which also provide means for establishing drainage. Use can also be made of bridges 24 which are welded between the top ends of the clamping frames 20. Each bridge 24 comprises a pair of telescopically interengaging tubes. These can be used for lifting with a gantry or other type of crane.

While not all similar members in the drawings have been numbered, it will be apparent that unnumbered members which appear similar to numbered members are of similar construction to the numbered members.

A consideration of the above embodiment will indicate that the invention has a number of advantages over known prior art;

(1) There is a large ratio of timber area to volume (in the order of one square meter per 100 liters) and this results in a very effective transfer of flavour characteristics to the wine from the timber.

(2) When timber has been used a number of times with one surface exposed to the air and the other surface in contact with the wine, further usage can still be achieved by simply reversing the timber panels side for side.

(3) The use of the channel section peripheral frame and the angle section clamping frames provides an extremely strong container which is capable of withstanding rough usage without damage.

(4) Since every stave which is used is of rectangular shape, there is a minimum loss of wood in the interconnection of the staves, the only loss being associated with regular sawing, and the formation of the tongues and grooves.

(5) Since the container is rectangular, much better use is made of available stacking and storage space.

Some winemakers prefer to finish off fermentation of their wine in casks. As control of temperature during the fermentation process is most important for the quality of the wine produced, problems arise in controlling temperature inside a cask, due to the difficulties of placing a cooling coil inside such a vessel. With the container of this invention, which can also be used for cold stabilisation of wine, cooling is facilitated. Red and white wines contain tartaric acid in solution. When the wine is chilled the tartaric acid precipitates in the form of insoluble crystals, which some consumers regard as undesirable. Wineries normally use special stainless steel tanks fitted with cooling coils, through which chilled brine is pumped, to chill the wine and precipitate the tartaric acid before bottling. The container of this invention can double as a cold stabilisation tank, and save investment in stainless steel tanks for that purpose. As this process takes only a matter of hours, unwanted wood flavour pick-up does not constitute a problem.

It is desirable that oxygen from the air be excluded from the maturing wine (other than the minute quantities of oxygen passed through the staves due to "breathing). Therefore casks must be constantly "topped up". Since containers according to this invention can be of large volume (without loss of volume/area ratio), there is a labour saving in "topping up", compared with "topping up" of casks, which, when stacked, are difficult to get at. In some embodiments of the invention, a header tank provides automatic "top-up" means which thereby entirely eliminate this manual operation. The container can be also easily cleaned "in situ", by using a filling and draining hole, such that a high pressure hose could be placed through the top of the container, and the residue pumped out through the bottom. In comparison with prior art methods, casks usually have to be taken from the stack into a yard for cleaning one by one.

Staves could be shaved (for example, with a sanding disc) after they have been reversed, and while the container is "in situ" and full of wine, thus taking advantage of slack periods in the winery. By comparison, cask staves can only be shaved on one side due to the curvature of the staves. The effective life of the container would thus be double that of a cask, making much greater use of scarce oak timber.

We claim:

1. A container for the storage of wine, comprising:

a plurality of channel section members interconnected to define the container shape, each member having a central web and a flange on each longitudinal side of the web, the webs of said channel section members together defining upper, lower and end walls of the container and bounding two open vertical sides of the container, a pair of timber panel assemblies, one on each of said open vertical sides bounded by the channel section members, each timber panel assembly engaging the corresponding flanges of the channel section members, resilient jointing material between each of said flanges of the channel section members and the associated one of the timber panel assemblies, a pair of clamping frames, each contiguous with the outer surface of the respective one of the timber panel assemblies, and a plurality of clamping bolts extending between the clamping frames and clamping the clamping frames, the timber panel assemblies, the resilient jointing material and the channel section members together.

2. A container according to claim 1 wherein each said clamping frame comprises angle section frame members, and clamped portions of said timber panel assemblies lie between flanges of said angle section frame members and the flanges of said channel section frame members.

3. A container according to claim 1 wherein each said clamping frame comprises angle section frame members, and said clamping bolts extend through sleeves on the angle section frame members and also through brackets on the peripheral frame members.

4. A container according to claim 1 or claim 3 further comprising base members secured to a said peripheral frame member elevating the lower wall of the container by an amount sufficient for insertion of the forks of a fork lift truck.

5. A container according to claim 1 further comprising bridges extending between said clamping frames above the upper wall of said container.

* * * * *